US006810951B1

(12) United States Patent
Dumetz

(10) Patent No.: US 6,810,951 B1
(45) Date of Patent: Nov. 2, 2004

(54) FLAT TUBE FOR HEAT EXCHANGER OF REDUCED WIDTH

(75) Inventor: Yvon Dumetz, Chatillon (FR)

(73) Assignee: Valeo Thermique Moteur, La Verriere (FR)

( * ) Notice: Subject to any disclaimer, the term of this patent is extended or adjusted under 35 U.S.C. 154(b) by 163 days.

(21) Appl. No.: 09/601,237

(22) PCT Filed: Nov. 29, 1999

(86) PCT No.: PCT/FR99/02951

§ 371 (c)(1),
(2), (4) Date: Nov. 27, 2000

(87) PCT Pub. No.: WO00/33008

PCT Pub. Date: Jun. 8, 2000

(30) Foreign Application Priority Data

Nov. 30, 1998 (FR) ..... 98 15063

(51) Int. Cl.[7] ..... F28F 9/16; F28F 1/02

(52) U.S. Cl. ..... 165/173; 165/177; 165/178; 165/183

(58) Field of Search ..... 165/177, 183, 165/173, 178, 175

(56) References Cited

U.S. PATENT DOCUMENTS 5,219,024 A * 6/1993 Potier ..... 165/173
5,579,832 A * 12/1996 Le Gauyer ..... 165/173
5,765,634 A * 6/1998 Martins ..... 165/177
6,263,570 B1 * 7/2001 Cazacu ..... 165/173 X

FOREIGN PATENT DOCUMENTS

| | | | |
|---|---|---|---|
| DE | 4432972 | 4/1995 | |
| DE | 19746371 | 5/1998 | |
| EP | 0505243 | 9/1992 | |
| FR | 2700610 | 7/1994 | |
| FR | 2735221 | * 12/1996 | |
| JP | 63-242432 | * 10/1988 | ..... 165/183 |
| JP | 6-123571 | * 5/1994 | ..... 165/177 |
| WO | 8607628 | 12/1986 | |

* cited by examiner

*Primary Examiner*—Leonard Leo
(74) *Attorney, Agent, or Firm*—Liniak, Berenato & White

(57) ABSTRACT

The invention concerns a tube (1) internally divided into two longitudinal channels (16) by a median spacer (9). In an end zone (4) penetrating a fluid box (19), the tube is deformed so as to be widened in its transverse section and shortened on either side of the spacer in the direction thereof. The space requirement of the fluid box in the longitudinal direction of the transverse sections of the tubes, and consequently the space requirement of the whole heat exchanger, can thereby be reduced relatively to the maximum space requirement of the array formed by the tubes and the separators (5) stacked therewith. The invention is applicable to cooling radiators of engines powering motor vehicles.

6 Claims, 1 Drawing Sheet

FLAT TUBE FOR HEAT EXCHANGER OF REDUCED WIDTH

The invention relates to a flat tube for the circulation of a fluid in a heat exchanger, especially a radiator for cooling the engine powering a motor vehicle, formed by a strip of sheet metal folded so as to define a peripheral wall separating the interior of the tube from the exterior and an intermediate wall or spacer mechanically reinforcing the tube and dividing the interior thereof into two longitudinal flow channels which are open at at least one first end of the tube, the mechanical connection between the peripheral wall and the spacer being provided partly by the continuation of the material of the strip and partly by brazing, the tube including a body which features a substantially constant elongate cross section.

In order to produce a heat exchanger, such tubes are gathered together into a tube array in which they are aligned in one or more rows and separated from one another by fins which furthermore enhance the exchange of heat between the fluid flowing in the tubes and an airflow flowing between them and sweeping over the fins. The channels of each tube open out at the first end thereof into a fluid chamber, one wall of which consists of a collector plate or collector pierced with holes through which the end zones of the tubes pass in a leaktight fashion.

In the known heat exchangers thus constituted, the cross section of the tubes is substantially constant over their entire length. In the direction of the length of this cross section, the overall size of the exchanger is therefore related to that of the set of tubes, the fluid chamber necessarily extending, in this direction and both ways, beyond the single row or the set of rows of tubes.

This constraint constitutes a drawback, especially in motor-vehicle construction, where the space for housing the components is measured out ever more sparingly.

The object of the invention is to remedy this drawback, by reducing the total overall size of the heat exchanger for a given size of the array of tubes.

The invention especially envisages a tube of the type defined in the introduction, and provides, moreover, for it to include at least one head region extending between its body and the said first end, in which the said peripheral wall, but not the spacer, is deformed in such a way as to dilate the channels in the direction of the width of the said cross section and to shrink them again towards the spacer in the direction of the length of the cross section.

The shrinking of the channels towards the spacer in the head region has the effect that, by comparison with the overall size of the tube array in the direction of the length of the cross section of the tubes, the overall size of the head region, and consequently the minimum overall size of the fluid chamber, which interacts with it, are reduced. The absence of deformation of the spacer allows it to keep its reinforcing function and, as appropriate, its function of leaktightness between the two channels.

Complementary or alternative optional characteristics of the invention are set out below:

- the head region comprises an end zone of substantially constant cross section corresponding to a maximum deformation and a transition zone linking the end zone to the body and in which the cross section changes progressively between those of the end zone and of the body.
- in the head region, the width of the said cross section varies progressively, from the spacer and on either side of it, from a minimum value to a maximum value.

- the flow channels are open at the second end of the tube, and the latter further includes a second head region extending between its body and its second end, the peripheral wall being deformed in the same way in the two head regions.
- the spacer is formed by two marginal zones of the said strip, brazed mutually face-to-face, the opposite edge faces of the strip, adjacent respectively to these two zones, coming opposite the inner face of the peripheral wall to which they are brazed.
- the strip is folded into a configuration which is symmetric with respect to the general plane of the spacer.

A further subject of the invention is a heat exchanger, especially a cooling radiator for the engine powering a motor vehicle, comprising at least one row of tubes as defined above, which are aligned in the direction of the width of their cross section, a fluid chamber being associated with the head region or with each head region of the set of tubes, a wall or collector plate of this fluid chamber being pierced by holes through which pass the end zones of the tubes, in such a way that the channels open out into the fluid chamber.

The characteristics and advantages of the invention will be set out in further detail in the description which follows, referring to the attached drawings.

Figure 1:
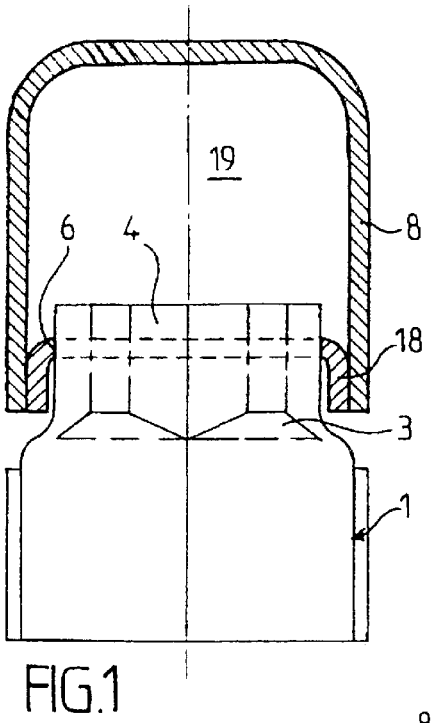
FIGS. 1, 2 and 3 are partial views respectively in cross section, in longitudinal section and in perspective of a heat exchanger according to the invention.
Figure 2:
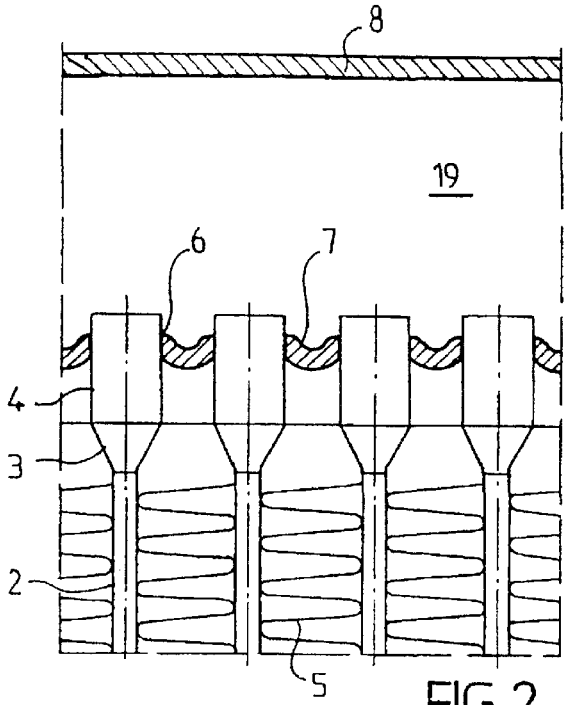
Figure 3:
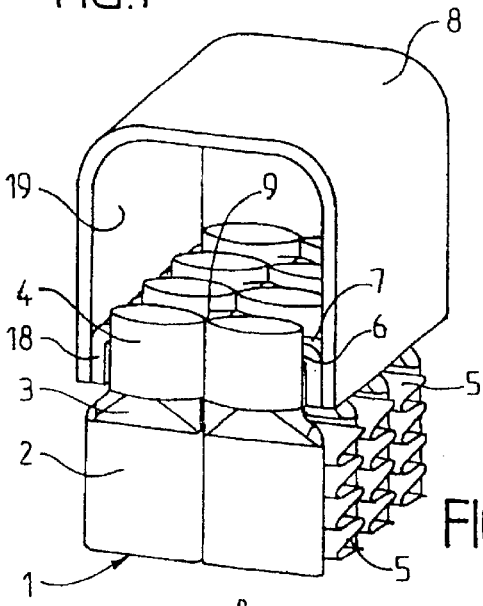
Figure 5:
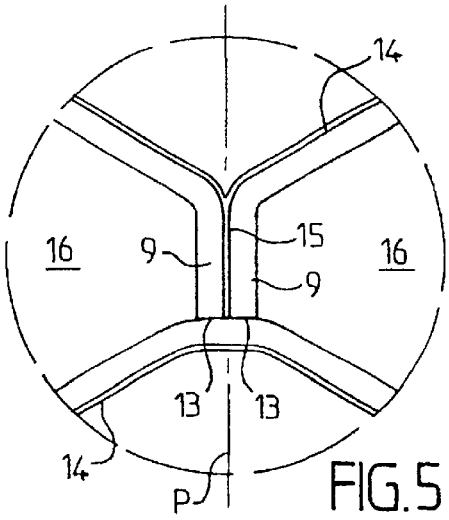
FIG. 5 is a detail of FIG. 4 on a larger scale.
Figure 4:
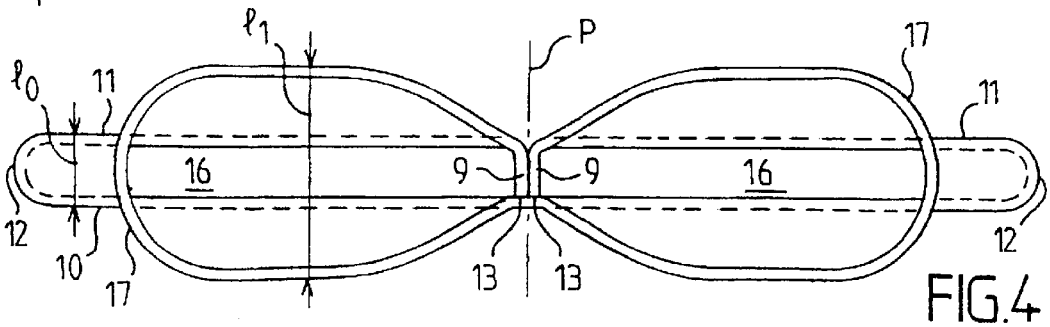
FIG. 4 is a top view of one of the tubes of this heat exchanger.

The heat exchanger represented in FIGS. 1 to 3 comprises a row of tubes 1, one of which is also represented in FIG. 4 and partially in FIG. 5. Each tube comprises an elongate body 2 being connected, by means of a transition zone 3, to an end zone 4. These three parts will be described in detail later on. Between the bodies of two adjacent tubes of the row a separator 5 is arranged in the form of a corrugated metal foil, the corrugation ridges of which come into contact alternately with these two tubes. The set of tubes and of separators forms an array of tubes in which the tubes are spaced apart from one another by a defined pitch. The end zone 4 of each tube passes through a hole 6 of a collector plate 7 which co-operates in a known way with a tank-shaped component 8 so as to define a fluid chamber 19.

Each tube 1 is formed from a strip of sheet metal which is folded so as, in the first place, to form a profile the cross section of which corresponds to that of the body 2. As can be seen in FIG. 4, this profile is symmetric with respect to a plane P. It comprises a spacer formed by the two marginal regions 9 of the strip, placed mutually alongside on either side of the plane P. The rest of the width of the strip forms the peripheral wall of the tube, made up of a flat side 10 originating from a middle region of the strip, of two flat half-sides 11, opposite the side 10, originating from regions of the strip which is [sic] adjacent to the marginal regions 9, the sides 10 and 11 being connected together by two rounded wall elements 12. The two opposite edge faces 13 of the strip bear on the inner face of the side 10, midway along its width.

In FIG. 5, which shows, on a larger scale, the spacer and a part of the peripheral wall in the vicinity thereto, can furthermore be seen a deposit of brazing alloy 14 applied to the face of the strip which forms the outer face of the peripheral wall, this deposit of brazing alloy furnishing a common layer 15 between the two marginal zones 9 forming the spacer. This layer 15, after melting and solidifying, provides the mechanical connection of the two zones 9 with each other and with the side 10, and leaktightness to the fluid between the two channels 16 delimited by the spacer within the tube. The layer 14 can be completed, if appropriate, by a layer of brazing alloy, not represented, covering over the inner face of the strip and/or the edge faces 13.

According to the invention, the peripheral wall 10–12 of the tubes is deformed, by comparison with the cross section described above, in the head region formed by the transition zone 3 and the end zone 4. In contrast, the spacer 9, 9 extends without deformation along the plane P, up to the end of the tube. In the end zone 4, the tube exhibits a constant cross section, visible in FIG. 4, which is still symmetric with respect to the plane P and which is characterised by a larger width (in the direction of alignment of the tubes) and a shorter length than those of the cross section of the original profile and of the body 2. As can be seen in FIG. 4, the width of this deformed cross section, from the spacer and on either side of the plane P, increases progressively from the value $l_0$ corresponding to the width of the cross section of the body up to a maximum value $l_1$ which it retains over part of the length of the section, then again reduces according to a rounded feature 17 which is convex outwards. The widening of the cross section is accompanied by shortening thereof, the size of the tube in the longitudinal direction of the cross section being less, on either side of the plane P, for the end zone 4 than for the body 2. As can be seen in FIGS. 1 to 3, the cross section varies progressively, along the transition zone 3, between that of the body 2 and that of the end zone 4.

The collector 7 includes a rim 18 turned towards the body 1 of the tubes, placed alongside and brazed to the inner face of the tank 8, over the entire periphery of the latter, for leaktight closure of the fluid chamber 19. The size of the fluid chamber, in terms of width, is thus at least equal to the length of the cross section of the end zone 4 of the tubes, increased by twice the thickness of the rim 18 and of the wall of the tank 8. As can be seen in FIG. 1, the invention makes it possible to limit this overall size to a value corresponding to the overall size of the array, defined by the separators 5 which project very slightly on either side of the row of tubes. Needless to say, it is also possible to set the deformation of the head region of the tubes in such a way that the overall size, in terms of width, of the heat exchanger is smaller, or larger, in the region of the fluid chamber than in the region of the bodies of the tubes, depending on the space available.

In a known way, the heat exchanger may comprise a second fluid chamber, not represented, communicating with the ends of the tubes opposite to those visible in the figures. Each tube may then feature a second head region deformed in the same way as that represented, making it possible, in the same way, to reduce the overall size of the second fluid chamber. In a variant, also as known, other means may be provided in order to allow the fluid to circulate in the tubes along a U-shaped path, starting from the fluid chamber 19 and returning thereto.

The deformation of the head regions can be achieved by inserting a punch of appropriate shape into them, in the longitudinal direction of the tubes.

What is claimed is:

1. Flat tube (1) for the circulation of a fluid in a heat exchanger, especially a radiator for cooling the engine powering a motor vehicle, formed by a strip of sheet metal folded so as to define a peripheral wall (10–12) separating the interior of the tube from the exterior and an intermediate spacer (9, 9) mechanically reinforcing the tube and dividing the interior thereof into two longitudinal flow channels (16) which are open at at least one first end of the tube, the mechanical connection between the peripheral wall and the spacer being provided partly by the continuation of the material of the strip forming the peripheral wall and partly by brazing, the tube including a body (1) which features a substantially constant elongate cross section and at least one head region (3, 4) extending between said body and said at least one first end, wherein said peripheral wall, but not the spacer, is deformed in such a way as to dilate the channels in the direction of the width of said cross section and to shrink them again towards the spacer in the direction of the length of the cross section, wherein the spacer is formed by two marginal zones (9, 9) of said strip, brazed mutually face-to-face continuously along their entire length, the opposite edge faces (13, 13) of the strip, adjacent respectively to these two zones, coming opposite the inner face of the peripheral wall (10) to which they are brazed.

2. Tube according to claim 1, characterised in that the head region comprises an end zone (4) of substantially constant cross section corresponding to a maximum deformation and a transition zone (3) linking the end zone to the body and in which the cross section changes progressively between those of the end zone and of the body.

3. Tube according to claim 1, characterised in that, in the head region, the width of said cross section varies progressively, from the spacer and on either side of it, from a minimum value ($l_0$) to a maximum value ($l_1$).

4. Tube according to claim 1, characterised in that the flow channels are open at its second end, and in that it further includes a second head region extending between its body and its second end, the peripheral wall being deformed in the same way in the two head regions.

5. Tube according to claim 1, characterised in that the strip is folded into a configuration which is symmetric with respect to the general plane (P) of the spacer.

6. Heat exchanger, especially a cooling radiator for the engine powering a motor vehicle, comprising at least one row of tubes (1), each tube of said row having the structure defined by claim 1, which are aligned in the direction of the width of their cross section, a fluid chamber (19) being associated with the head region (3, 4) or with each head region of the set of tubes, a wall (7) defining a collector plate of this fluid chamber being pierced by holes (6) through which pass end zones (4) of the tubes, in such a way that the channels (16) open out into the fluid chamber (19).

* * * * *

UNITED STATES PATENT AND TRADEMARK OFFICE

CERTIFICATE OF CORRECTION

PATENT NO. : 6,810,951 B1
DATED : November 2, 2004
INVENTOR(S) : Dumetz

It is certified that error appears in the above-identified patent and that said Letters Patent is hereby corrected as shown below:

Title page,
Item [*] Notice, delete “163” and insert -- 423 --.

Signed and Sealed this

Thirtieth Day of August, 2005

JON W. DUDAS
*Director of the United States Patent and Trademark Office*